US009228801B2

(12) United States Patent
Hosz

(10) Patent No.: US 9,228,801 B2
(45) Date of Patent: Jan. 5, 2016

(54) ATTACHMENT FIRING APPARATUS

(71) Applicant: STEYR MANNLICHER GmbH, Kleinraming (AT)

(72) Inventor: Christian Hosz, Oberpetersdorf (AT)

(73) Assignee: Steyr Mannlicher GmbH, Kleinraming (AT)

( * ) Notice: Subject to any disclaimer, the term of this patent is extended or adjusted under 35 U.S.C. 154(b) by 0 days.

(21) Appl. No.: 14/349,739

(22) PCT Filed: Sep. 26, 2012

(86) PCT No.: PCT/AT2012/050143

§ 371 (c)(1),
(2) Date: Apr. 4, 2014

(87) PCT Pub. No.: WO2013/049870

PCT Pub. Date: Apr. 11, 2013

(65) Prior Publication Data

US 2014/0237883 A1 Aug. 28, 2014

(30) Foreign Application Priority Data

Oct. 7, 2011 (AT) ..... A 1454/2011

(51) Int. Cl.
*F41C 27/06* (2006.01)
*F41C 27/00* (2006.01)

(52) U.S. Cl.
CPC ..... *F41C 27/06* (2013.01); *F41C 27/00* (2013.01)

(58) Field of Classification Search
CPC ..... F41A 3/04; F41A 3/06; F41C 27/00; F41C 27/06
USPC ..... 42/105
See application file for complete search history.

(56) References Cited

U.S. PATENT DOCUMENTS

| | | | | |
|---|---|---|---|---|
| 3,641,691 | A | 2/1972 | Ellis et al. | |
| 4,689,911 | A * | 9/1987 | White | 42/105 |
| 6,481,145 | B2 | 11/2002 | Weichert et al. | |
| 6,629,379 | B1 * | 10/2003 | Doiron | 42/70.11 |
| 7,661,348 | B2 | 2/2010 | Murello | |
| 2007/0074437 | A1 * | 4/2007 | Compton et al. | 42/12 |

FOREIGN PATENT DOCUMENTS

| | | |
|---|---|---|
| DE | 19925864 | 8/2000 |
| DE | 102005019594 | 11/2006 |
| EP | 0085193 | 8/1983 |
| GB | 2218191 | 8/1989 |
| RU | 2302602 | 7/2007 |
| WO | WO2009062670 | 11/2008 |

OTHER PUBLICATIONS

ISA Written Opinion for PCT/AT2012/050143.
Austrian Office Action dated Aug. 8, 2012.

* cited by examiner

*Primary Examiner* — Stephen M Johnson
(74) *Attorney, Agent, or Firm* — Hoffmann & Baron, LLP

(57) ABSTRACT

An attachment firing apparatus, in particular a grenade launcher, for mounting on the barrel of a firearm, having an anchoring part that can be fixedly mounted on the firearm and having a support part that can be detachably connected to the anchoring part via a coupling, a launch tube in the support part being openable and closable relative to a breech, wherein the coupling is locked in the closed position of the launch tube and breech and can be opened in the open position of the launch tube and breech.

17 Claims, 3 Drawing Sheets

ATTACHMENT FIRING APPARATUS

CROSS-REFERENCE TO RELATED APPLICATIONS

This application is a National Phase application of International Application No. PCT/AT2012/050143 filed Sep. 26, 2012 which claims priority to Austrian Patent Application No. A 1454/2011 filed Oct. 7, 2011, the disclosures of which are incorporated herein by reference.

BACKGROUND

The present invention relates to an attachment firing apparatus, in particular a grenade launcher, for mounting on the barrel of a firearm.

Known attachment apparatuses of this type are either slid over the barrel (for example GB 2 218 191 A, EP 0 085 193 A1) or mounted on Picatinny rails of the barrel and fixed using attachment screws. In both cases there is the risk of accidental firing of a shot when handling the equipment during the mounting and dismounting procedures. The object of the invention is to create an attachment firing apparatus having increased safety.

SUMMARY

This object is achieved with an attachment firing apparatus of the type mentioned in the introduction, which, in accordance with the invention, is characterised by an anchoring part that can be fixedly mounted on the firearm and by a support part that can be detachably connected to the anchoring part via a coupling, a launch tube in the support part being openable and closable relative to a breech, wherein the coupling is locked in the closed position of the launch tube and breech and can be opened in the open position of the launch tube and breech.

The attachment firing apparatus of the invention can only be mounted and dismounted in the open state, such that an unintentional firing of a shot is impossible during this handling process. In addition, the open attachment firing apparatus gives the user a direct view of the charge state during mounting and dismounting, which contributes further to safety.

In principle, in the attachment firing apparatus of the invention, either the breech can be mounted movably with respect to the launch tube in the support part, or the launch tube can be mounted movably with respect to the breech, or both the breech and the launch tube can be movable with respect to one another. The breech is preferably fixed in the support part and the launch tube is movable with respect thereto. Here, the launch tube, as is known per se, can be mounted in the support part such that the launch tube is linearly displaceable and can also be pivoted out with respect to the fixed breech. The attachment firing apparatus of the invention is preferably of the last-mentioned type, and the launch tube locks the coupling when pivoted in. If the launch tube is pivoted out, the user can get a particularly good view of the charge state of the launch tube.

The movable one of the parts constituted by the launch tube and the breech can in each case lock the coupling directly, for example by engaging in the coupling via an inherent extension, a lug, a locking pin or the like. In accordance with a preferred embodiment of the invention the coupling can be locked by a separate locking member, which is mounted movably in the support and which is blocked in the aforementioned closed position by at least one of the parts constituted by the launch tube and the breech. The coupling therefore still remains closed when the attachment apparatus is opened, and only the blocking of the locking member is released, such that the coupling can be opened by subsequent unlocking of the locking member. This increases safety further still during the handling process. In the case of a launch tube that can be pivoted out, the locking member can be blocked directly in this way by the launch tube pivoting in.

The coupling is preferably a plug-and-slide coupling, of which the sliding direction runs in the barrel direction, which enables simple and safe mounting and dismounting. In conjunction with a launch tube that can be pivoted out, this results in particularly safe and obvious operation, because the coupling is thus locked and unlocked by pivoting the launch tube in and out transversely to the barrel direction, whereas the coupling is opened by sliding in the barrel direction.

The attachment firing apparatus of the invention is suitable for all types of firing mechanisms known in the prior art and ammunition therefor. A single-shot grenade launcher is preferred, in particular what is known as an under-barrel grenade launcher, which is mounted below the front barrel of an assault rifle.

BRIEF DESCRIPTION OF THE DRAWINGS

The invention will be explained in greater detail hereinafter on the basis of an exemplary embodiment illustrated in the accompanying drawings, in which.

Figure 1:
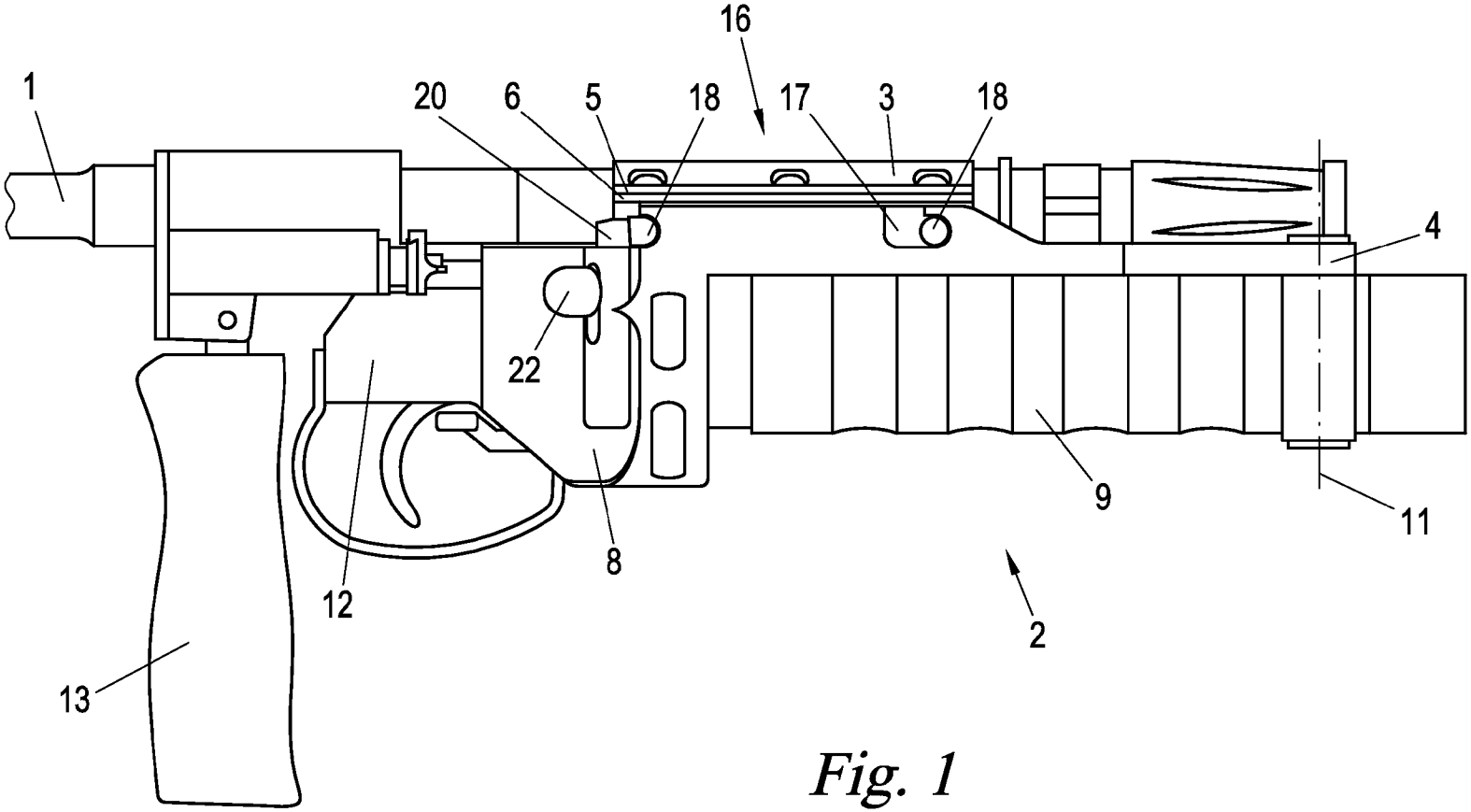
FIG. 1 shows a side view of the attachment firing apparatus of the invention mounted on a firearm and in the closed state.
Figure 2:
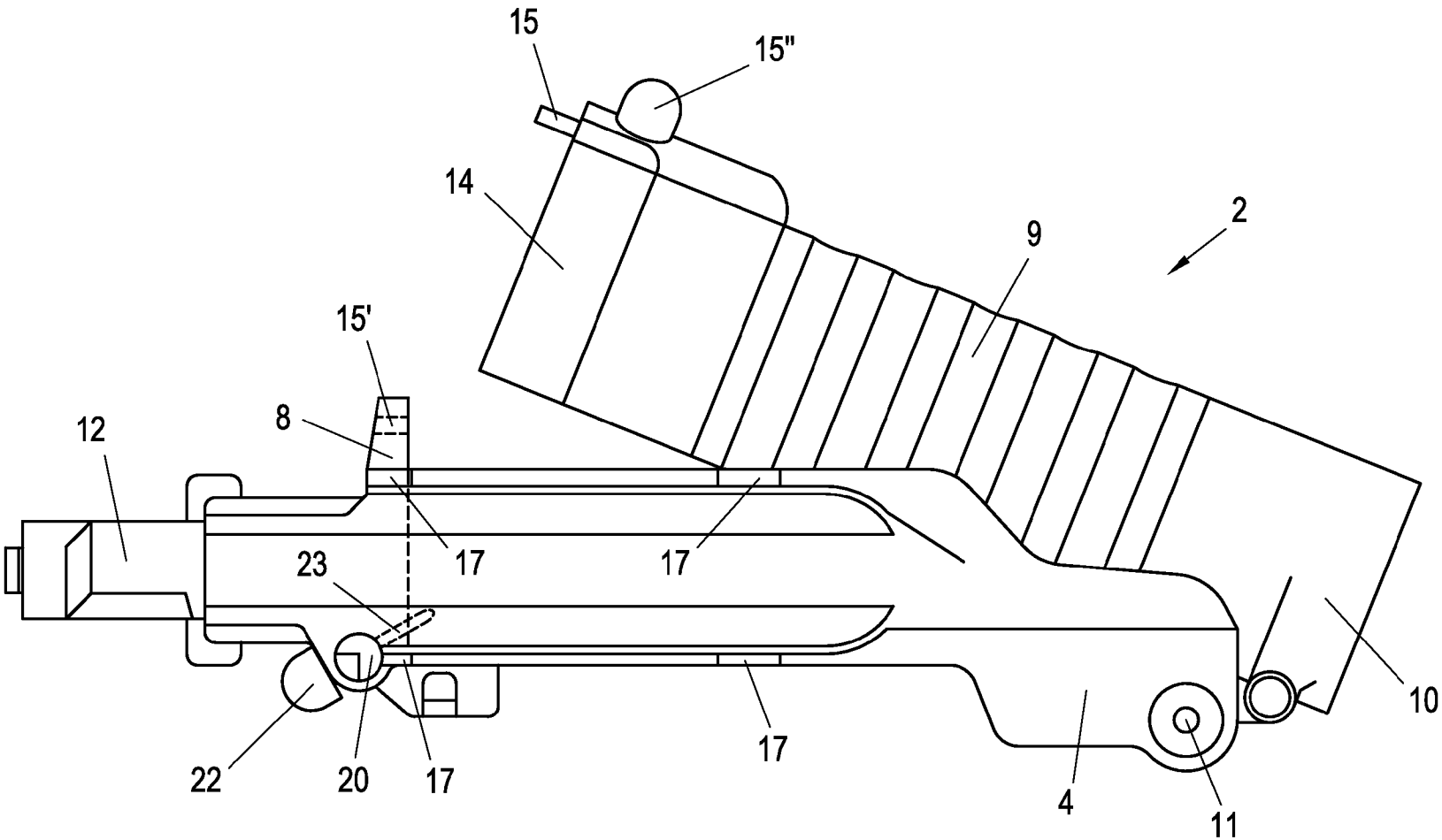
FIG. 2 shows a plan view of the support part of the attachment firing apparatus of FIG. 1 in the dismounted and opened state.
Figure 3:
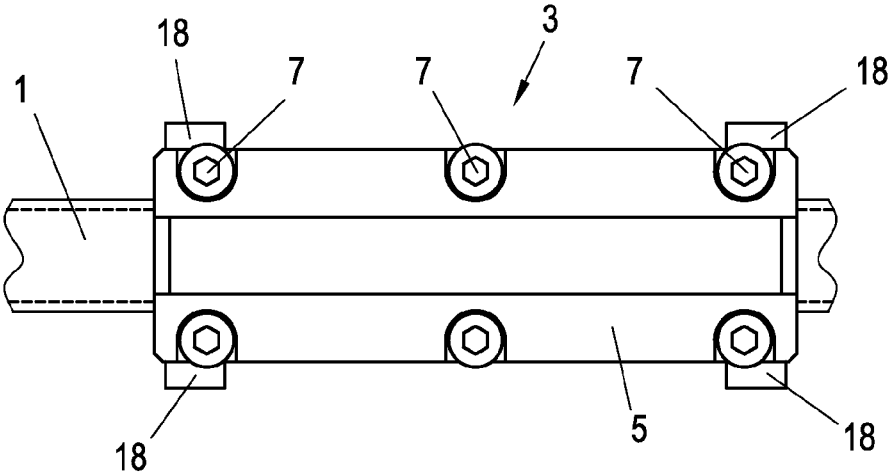
FIG. 3 shows a plan view of the anchoring part of the attachment firing apparatus from FIG. 1.

According to FIGS. 1 to 3, an attachment firing apparatus 2 for large caliber ammunition, for example 40 mm grenades, is mounted on a barrel 1 of a firearm (not illustrated in further detail), for example of an assault rifle. The attachment firing apparatus 2 is formed in two parts, with a first anchoring part (FIG. 3) that can be fixedly mounted on the barrel 1, and with a second support part (FIGS. 2 and 4) that can be detachably coupled to the anchoring part.

The anchoring part 3 in the shown example is a sleeve divided into two, of which both parts 5, 6 surround the barrel 1 and are fixed to one another by means of screws 7 in order to tightly clamp the barrel 1. A one-part sleeve, which can be fixed to the barrel 1 by means of attachment screws, is also possible. Further, the anchoring part 3 could also be an adapter for a Picatinny rail and could be clamped tightly and/or screwed tightly thereon.

The support part 4 supports a breech 8 for a launch tube 9, which is mounted on the support part 4 such that it can be pivoted out at its muzzle-side end 10 about an axis 11 running transversely to the barrel 1 (FIG. 2). A housing having a firing and trigger arrangement 12 is attached to the breech 8. The firing and trigger arrangement 12, upon actuation to fire a shot by means of an internal firing pin or striker pin (not shown), contacts an ammunition inserted into a cartridge chamber 14 of the launch tube 9 so as to ignite said ammunition, as is known in the art. The barrel 1 may also be equipped with an additional grip 13 in order to facilitate the operation of the firing and trigger arrangement 12. Alternatively the grip 13 may also be assembled with the housing of the firing and trigger arrangement 12.

To charge, discharge or recharge the attachment firing apparatus 2, the launch tube 9 is pivoted out from the closed position shown in FIG. 1 into the open position shown in FIG. 2. In the closed position of FIG. 1, the pivot motion of the launch tube 9 is locked with the aid of a locking pin 15, which is mounted on the launch tube 9 (or on the breech 8) and engages in a corresponding complementary detent recess 15' on the respective other part. The locking pin 15 can be latched in place and unlatched for example with the aid of an outwardly protruding slide button 15".

DETAILED DESCRIPTION

The anchoring part 3 and support part 4 are detachably interconnected via a coupling 16. The coupling 16 may be of any type, for example a bayonet coupling, a screw coupling or the like. In the shown example the coupling 16 is a plug-and-slide coupling which comprises L-shaped grooves 17 on the support part 4 on the one hand and lateral detent lugs 18 on the anchoring part 3 on the other hand.

The plug-and-slide coupling 16 is closed by first inserting the detent lugs 18 into the first portion of the L-shaped grooves 17 transversely to the barrel direction 1 and then sliding them into the second portion of the L-shaped grooves 17 in the barrel direction 1. As illustrated, the grooves 17 are open against the firing direction, such that the hook parts 19 left on the support body 4 by the groves 17 latch onto the detent lugs 18 during firing in order to take up the recoil.

The plug-and-slide coupling 16 is locked with the aid of a locking member in order to prevent an unintentional opening during operation. In the shown example the locking member is a detent pin 20, which is mounted in the support body 4 so as to be movable transversely to the barrel direction and which, in its locking position, latches behind one of the detent lugs 18 in order to prevent said detent lug from exiting from the groove 17. The detent pin 20 can be acted on in the locking direction by a compression spring 21 and can be actuated via a slide button 22 exiting from the support part 4.

Figure 4:
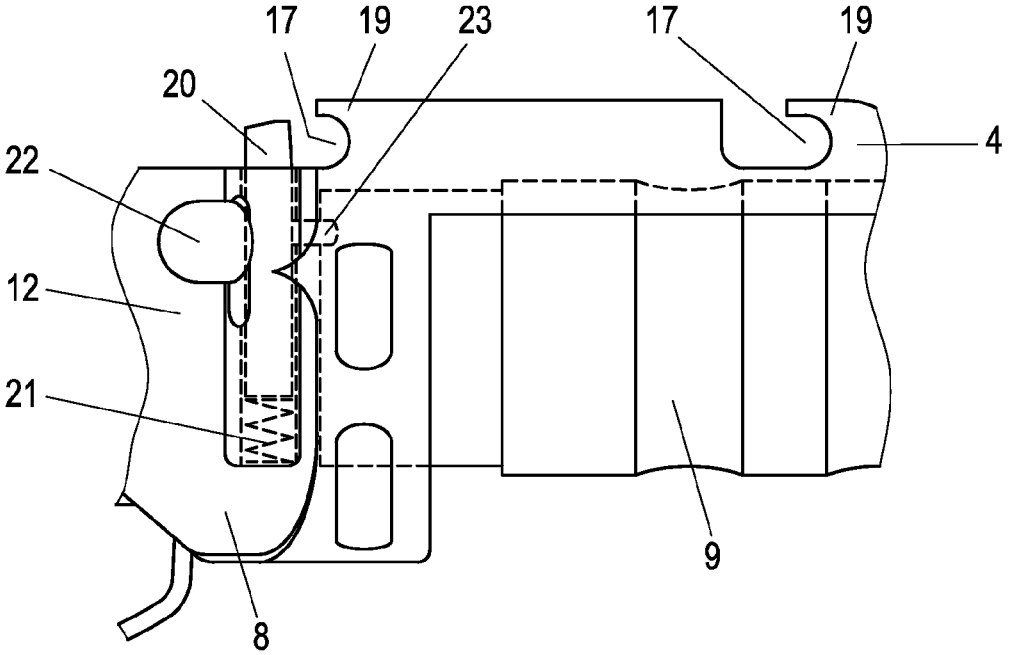
FIG. 4 shows a partly enlarged side view of a detail of the support part of the attachment firing apparatus from FIG. 1.

As shown in detail in FIGS. 2 and 4, the detent pin 20 further has an extension 23, which is directed towards the interior of the breech 8 and which, in the unlocked (pressed-down) position of the detent pin 20, projects into the movement path of the launch tube 9 over which it pivots in towards the breech 8. The detent pin 20 can thus then only be actuated and released by the detent lug 18 if the launch tube 9 is not pivoted in, that is to say if the breech is open. In other words, if the launch tube 9 is pivoted in and the breech is thus closed, this blocks the movement of the detent pin 20 and therefore the opening (releasing) of the coupling 16. The support part 4 can therefore only be mounted on the anchoring part 3 and therefore on the barrel 1 and dismounted therefrom in the pivoted-out or open position (FIG. 2).

Instead of a linearly displaceable detent pin 20, any other form of locking member could also be used, for example a pawl, a lever, a cam or the like.

Instead of via a locking member, such as the detent pin 20, the launch tube 9 could furthermore also lock the coupling 16 directly, for example by an extension protruding at the rear end of the launch tube 9 and coming to rest directly behind one of the detent lugs 18 when the launch tube is pivoted in. It is also possible, in the case of attachment firing apparatuses 2 in which the breech 8 is mounted movably and the launch tube 9 is mounted fixedly in the support part 4, to implement the locking and unlocking of the coupling 16 by means of a part of the moving breech 8. Lastly, in the case of a design of the coupling 16 other than a plug-and-slide coupling, it is also possible for one of the parts (or both parts) constituted by the breech 8 and launch tube 9 to lock a corresponding other part of the coupling 16, whether directly or via a locking member 20, during the closing movement: The coupling 16 for example could thus be a bayonet coupling, in which the support part 4 is mounted on the anchoring part 3 in a 90° rotary motion, and the launch tube for example could be linearly displaceable in the barrel direction and could engage via a lug in a guide of the anchoring part 3 during the closing process in order to lock the rotary motion of the coupling 16; or the launch tube 9 for example is a drop barrel, which locks the coupling 16 when being tilted up (closed).

The invention is not limited to the illustrated embodiments, but includes all variants and modifications that fall within the scope of the accompanying claims.

What is claimed is:

1. An attachment firing apparatus comprising:

an anchoring part configured to be fixedly mounted on a barrel of a firearm;

a support part detachably connected to the anchoring part via a coupling;

the support part comprising a breech;

a launch tube movably mounted on the support part between an open position and a closed firing position relative to the breech, wherein the coupling between the support part and anchoring part is locked to prevent detaching the support part from the anchoring part when the launch tube is in said closed firing position and unlocked to allow detaching of the support part from the anchoring part when the launch tube in said open position, and wherein the coupling is locked in said closed position by a locking member movably mounted in the support part, the locking member being blocked in said closed position by at least one of the launch tube and the breech to prevent unlocking of the locking member.

2. The attachment firing apparatus according to claim 1, wherein the launch tube is pivotally mounted in the support part such that a cartridge chamber end of said launch tube can be pivoted out away from the breech to the open position, and the launch tube locks the coupling when pivoted into the closed position.

3. The attachment firing apparatus according to claim 1, wherein the launch tube can be pivoted out away from the breech in the open position and wherein the launch tube blocks the locking member when pivoted to the closed position.

4. The attachment firing apparatus according to claim 1, wherein the attachment firing apparatus is a single-shot grenade launcher.

5. An attachment firing apparatus comprising:

an anchoring part configured to be fixedly mounted on a barrel of a firearm;

a support part detachably connected to the anchoring part via a coupling;

the support part comprising a breech;

a launch tube movably mounted on the support part between an open position and a closed firing position relative to the breech, wherein the coupling between the support part and anchoring part is locked to prevent detaching the support part from the anchoring part when the launch tube is in said closed firing position and unlocked to allow detaching of the support part from the anchoring part when the launch tube in said open position, and wherein the coupling is a plug-and-slide coupling comprising grooves and detent lugs.

6. The attachment firing apparatus according to claim 5, wherein the launch tube is pivotally mounted in the support part such that a cartridge chamber end of said launch tube can be pivoted out away from the breech to the open position, and the launch tube locks the coupling when pivoted into the closed position.

7. The attachment firing apparatus according to claim 5, wherein the coupling is locked in said closed position by a locking member movably mounted in the support part, the locking member being blocked in said closed position by at least one of the launch tube and the breech to prevent unlocking of the locking member.

8. The attachment firing apparatus according to claim 5, wherein the launch tube can be pivoted out away from the breech in the open position and wherein the launch tube blocks the locking member when pivoted to the closed position.

9. The attachment firing apparatus according to claim 5, wherein the attachment firing apparatus is a single-shot grenade launcher.

10. An attachment firing apparatus comprising:

an anchoring part adapted to be fixedly mounted on a barrel of a firearm;

a support part detachably connected to the anchoring part via a coupling;

a launch tube pivotally mounted to the support part at a muzzle end of the launch tube, the support part including a back wall, wherein the launch tube is pivotally movable away from the back wall of the support part to an open position and pivotally movable to align the launch tube with the back wall to a closed position, and further wherein the coupling of the support part to the anchoring part is locked when the launch tube is in the closed position to prevent detachment of the support part from the anchoring part and unlocked in the open position such that the support part can be detached from the anchoring part, and wherein the coupling is locked in the closed position by a locking member.

11. An attachment firing apparatus of claim 10, wherein the coupling comprises a plug-and-slide coupling including grooves on the support part and detent lugs on the anchoring part adapted to be slid into the grooves to mount the support part to the anchoring part.

12. An attachment firing apparatus of claim 11, wherein the locking member comprises a pin mounted on the support part movable transversely to a barrel direction which, in a locking position, latches behind a lug to prevent the lug from exiting the groove thereby locking the support part to the anchoring part.

13. An attachment firing apparatus of claim 12, wherein the locking member further includes an extension directed towards a center of the support part when the locking member is in an unlocked position, the extension projecting into a movement path of the launch tube to prevent the launch tube from being moved into the closed position thereby allowing the locking member pin to be moved to an unlocked position.

14. An attachment firing apparatus of claim 10, wherein the locking member is blocked from being moved to an unlocked position when the launch tube is in a closed position.

15. An attachment firing apparatus of claim 10, wherein the support part further includes a housing having a firing and trigger arrangement attached to the breech.

16. An attachment firing apparatus comprising:

an anchoring part adapted to be fixedly mounted on a barrel of a firearm;

a support part detachably connected to the anchoring part via a coupling;

a launch tube pivotally mounted to the support part at a muzzle end of the launch tube, the support part including a back wall, wherein the launch tube is pivotally movable away from the back wall of the support part to an open position and pivotally movable to align the launch tube with the back wall to a closed position, and further wherein the coupling of the support part to the anchoring part is locked when the launch tube is in the closed position to prevent detachment of the su ort art from the anchoring art and unlocked in the open position such that the support part can be detached from the anchoring part, and wherein the launch tube further includes a launch tube lock to retain the launch tube in the closed position.

17. An attachment firing apparatus of claim 16, wherein the launch tube lock comprises a locking pin and a corresponding complementary detent recess mounted on the launch tube and support part and adapted to be latched and unlatched.

* * * * *

UNITED STATES PATENT AND TRADEMARK OFFICE

CERTIFICATE OF CORRECTION

PATENT NO. : 9,228,801 B2
APPLICATION NO. : 14/349739
DATED : January 5, 2016
INVENTOR(S) : Hösz It is certified that error appears in the above-identified patent and that said Letters Patent is hereby corrected as shown below:

On the Title page:

Now reads: "Inventor: Christian Hosz, Oberpetersdorf (AT)..."

Should read: -- Inventor: Christian Hösz, Oberpetersdorf (AT)... --

Claims

Column 6, line 33, Claim 16:

Now reads: "position to prevent detachment of the su ort art from the anchoring art..."

Should read: -- position to prevent detachment of the support part from the anchoring part... --

Signed and Sealed this
Twenty-sixth Day of April, 2016

Michelle K. Lee

Michelle K. Lee
*Director of the United States Patent and Trademark Office*